US005339951A

United States Patent [19]

Chen

[11] Patent Number: 5,339,951

[45] Date of Patent: Aug. 23, 1994

[54] FOLDING GOLF BAG STAND MOUNTING HARDWARE

[76] Inventor: Cheng-Tung Chen, No. 631, Sec. 1, Chung Shan Rd., Tai Chia Chen, Taichung Hsien, Taiwan

[21] Appl. No.: 185,019

[22] Filed: Jan. 24, 1994

[51] Int. Cl.[5] ..... A63B 55/00

[52] U.S. Cl. ..... 206/315.7; 248/96

[58] Field of Search ..... 206/315.7, 315.3; 248/96, 297.2, 171, 688

[56] References Cited

U.S. PATENT DOCUMENTS

| | | | |
|---|---|---|---|
| 4,834,235 | 5/1989 | Solheim et al. | 206/315.7 |
| 5,048,777 | 9/1991 | Quellais | 206/315.7 X |
| 5,096,148 | 3/1992 | Quellais et al. | 206/315.7 X |
| 5,147,089 | 9/1992 | Anderson | 206/315.7 X |
| 5,152,483 | 10/1992 | Maeng | 206/315.7 X |
| 5,178,273 | 1/1993 | Igarashi | 206/315.7 |
| 5,236,085 | 8/1993 | Quellais | 206/315.7 |

*Primary Examiner*—Allan W. Shoap
*Assistant Examiner*—Christopher J. McDonald
*Attorney, Agent, or Firm*—Browdy and Neimark

[57] ABSTRACT

A folding golf bag stand mounting hardware includes two legs pivoted to a top mounting frame on the bag body of a golf bag and having a respective locating frame, a spring supported between the legs, an adjustable fastening belt inserted through the loop on the locating frame on either leg and having two opposite ends fastened to the bag body, a bottom mounting frame fastened to the bag body near the bottom thereof, a constraint member fastened to the bag body and aligned between the top and bottom mounting frames, a connecting rod having a bend in the middle hung on the bottom mounting frame and two opposite ends inserted through a hole on the constraint member and then respectively hung on a respective hanging hole on either locating frame, wherein the bottom mounting frame consists of a vertical mounting plate fastened to the bag body, a curved supporting plate pivoted to the vertical mounting plate in the middle, the curved supporting plate having a stop bar at one end, which stops at the vertical mounting plate when the curved supporting plate is extended out, a loop at an opposite end, which holds the bend of the connecting rod, a shoe and a friction block spaced on a bottom wall thereof, which stop on the ground when the supporting plate is extended out.

2 Claims, 8 Drawing Sheets

FOLDING GOLF BAG STAND MOUNTING HARDWARE

BACKGROUND OF THE INVENTION

The present invention relates to a folding golf bag stand mounting hardware which fastens a folding golf bag stand to a golf bag permitting the stand to be conveniently opened by the user to support the golf bag in a sloping position on the ground.

A variety of golf bags are manufactured and widely used in golf courses for carrying different golf clubs, golf balls, and umbrellas, etc. When a full set of golf clubs are carried in a golf bag, the golf bag does not stand up as it is placed on the ground. Therefore, the golf bag must be carried over the shoulder all the time. Various folding golf bag stands are disclosed to eliminate this problem.

FIG. 1 illustrates a golf bag having a folding for supporting the bag in a sloping position on the ground. The golf bag comprises a mounting plate fastened to the bag body near the top cuff thereof, two legs having a respective top end pivoted to a respective socket on the mounting plate, two connecting frames respectively fastened to the legs in the middle, an elastic fastening belt fastened to the bag body below the mounting plate to hold the connecting frames, a hinge fastened to the bag body near the bottom thereof, and a substantially V-shaped link connected between the hinge and the connecting frames on the legs. This structure of folding golf bag stand has drawbacks. One drawback of this structure of folding golf bag stand is that the spring power of the elastic fastening belt deteriorates quickly after long uses. Another drawback of this structure of folding golf bag stand is that the substantially V-shaped link cannot support much pressure. Still another drawback of this structure of folding golf bag stand is that the hinge cannot stably support the bag on the ground when it is extended out.

SUMMARY OF THE INVENTION

The present invention has been accomplished to provide a folding golf bag stand mounting hardware which eliminates the aforesaid drawbacks.

According to the preferred embodiment of the present invention, the folding golf bag stand mounting hardware comprises two legs respectively pivoted to a top mounting frame on the bag body of a golf bag and having a respective locating frame, a spring supported between the legs, an adjustable fastening belt inserted through the loop on the locating frame on either leg and having two opposite ends fastened to the bag body, a bottom mounting frame fastened to the bag body near the bottom thereof, a constraint member fastened to the bag body and aligned between the top and bottom mounting frames, a connecting rod having a bend in the middle hung on the bottom mounting frame and two opposite ends inserted through a hole on the constraint member and then respectively hung on a respective hanging hole on either locating frame. The bottom mounting frame comprises a vertical mounting plate fastened to the bag body, a curved supporting plate pivoted to the vertical mounting plate in the middle, the curved supporting plate having a stop bar at one end, which stops at the vertical mounting plate when the curved supporting plate is extended out, a loop at an opposite end, which holds the bend of the connecting rod, a shoe and a friction block spaced on a bottom wall thereof, which stop on the ground when the supporting plate is extended out.

DETAILED DESCRIPTION OF THE PREFERRED EMBODIMENT

Figure 1:
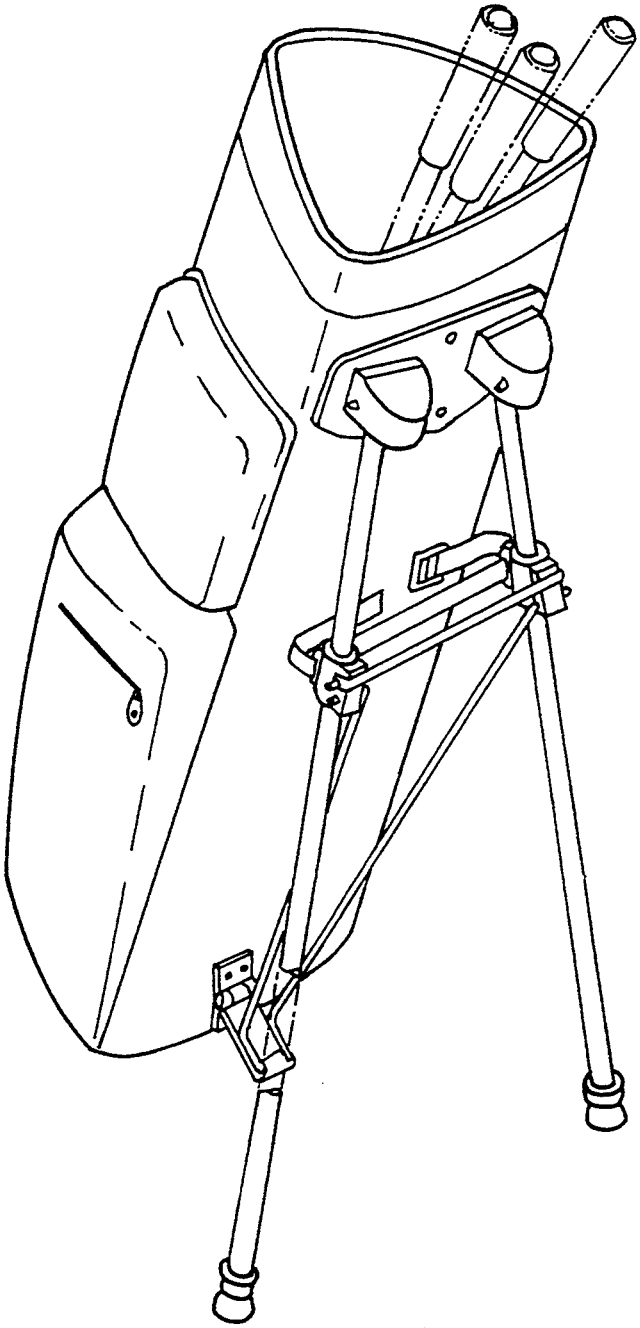
FIG. 1 PRIOR ART
FIG. 1 is an elevational view of a folding golf bag stand installed in a golf bag according to the prior art.
Figure 2:
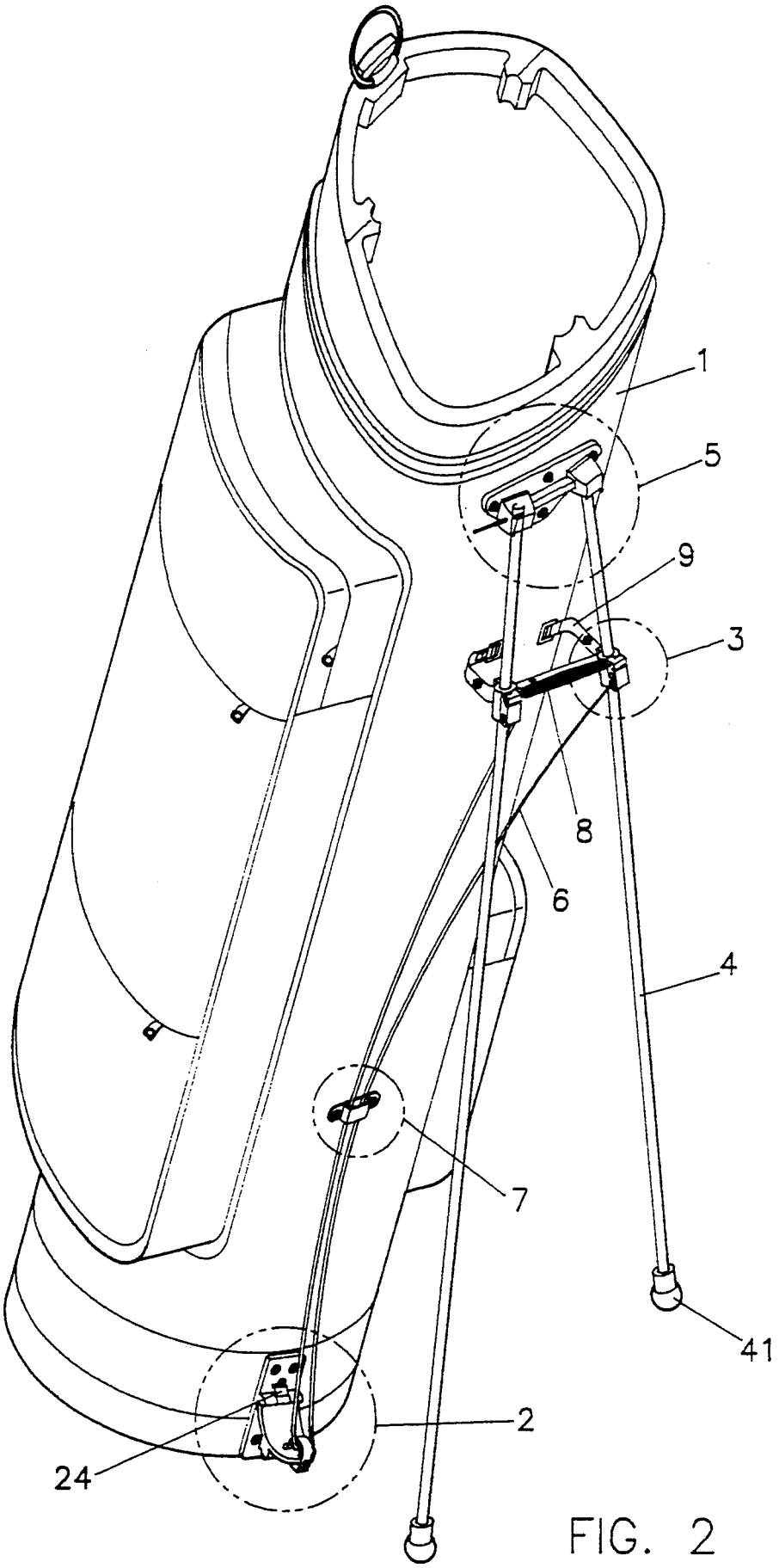
FIG. 2 is an elevational view of a folding golf bag stand mounting hardware according to the preferred embodiment of the present invention.

Referring to FIG. 2, the present invention is generally comprised of a golf bag 1, a bottom mounting frame 2, two locating frames 3, two legs 4, a top mounting frame 5, a connecting rod 6, a constraint member 7, a compression spring 8, and a fastening strap 9.

Figure 3:
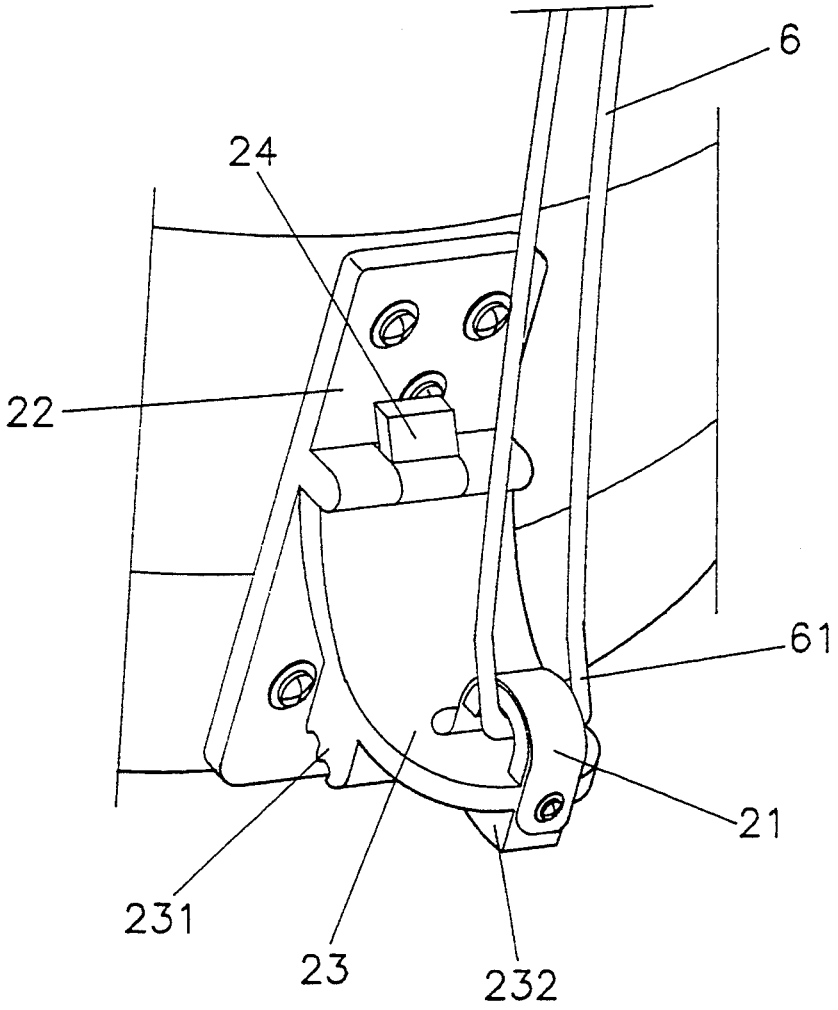
FIG. 3 is an enlarged view of the bottom mounting frame of the folding golf bag stand mounting hardware shown in FIG. 2.
Figure 4:
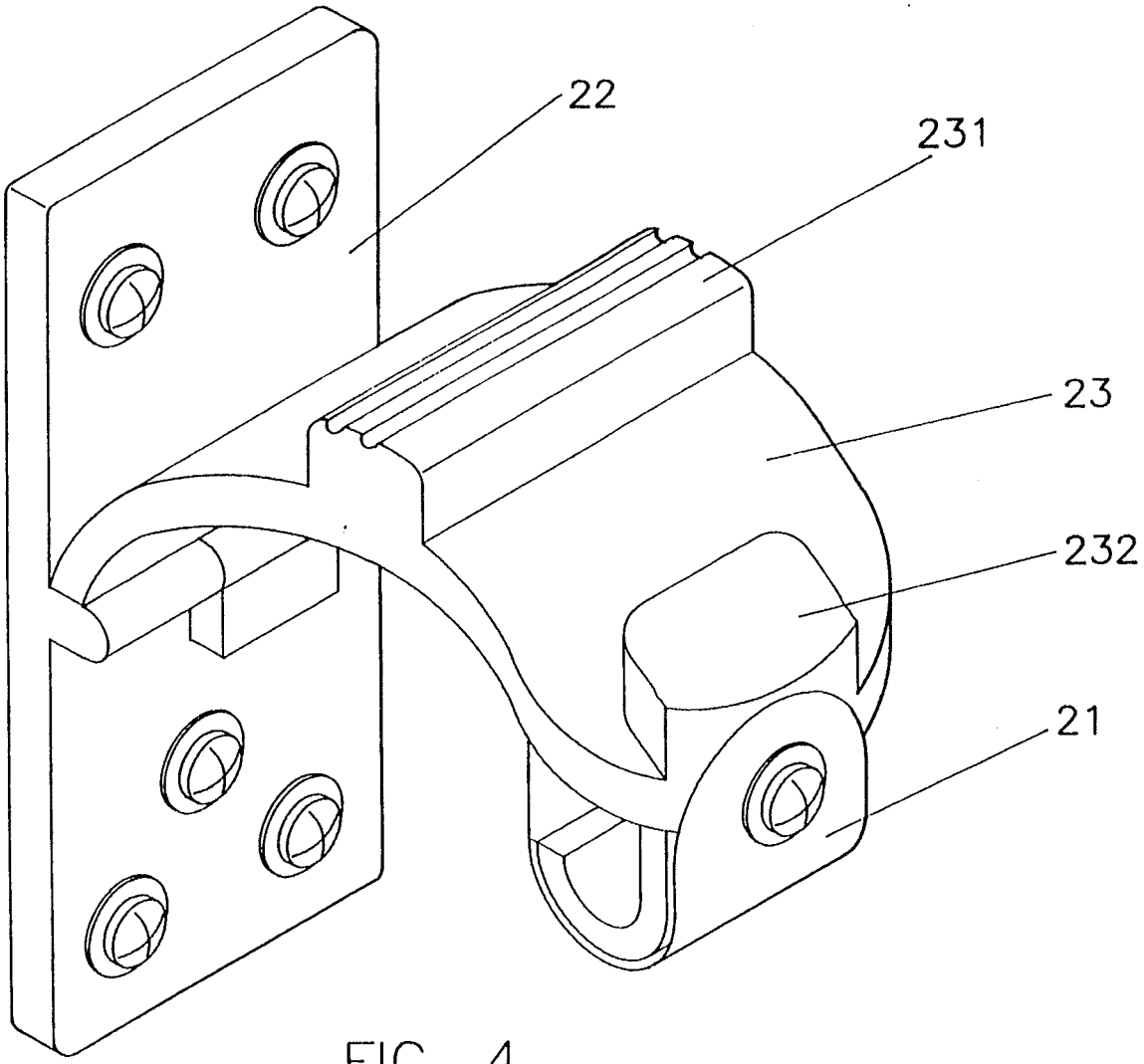
FIG. 4 is a bottom view of the bottom mounting frame shown in FIG. 3.

Referring to FIGS. 3 and 4 and FIG. 2 again, the bottom mounting frame 2 comprises a vertical mounting plate 22 fastened to the golf bag 1 near the bottom thereof by screws, a smoothly curved supporting plate 23 pivoted to the mounting plate 22 in the middle. The supporting plate 23 comprises a stop bar 24 at one end, which stops at the vertical mounting plate 22 when the supporting plate 23 is extended out into the operative position, a loop 21 at an opposite end, which holds the middle part 61 of the connecting rod 6, and a shoe 232 and a friction block 231 spaced on the bottom thereof, which stop on the ground to support the supporting plate 23 in the operative position when the supporting plate 23 is extended out. The friction block 231 is made corrugated, and therefore it firmly grasps the ground when the bottom mounting frame 2 is disposed in the operative position.

Figure 5:
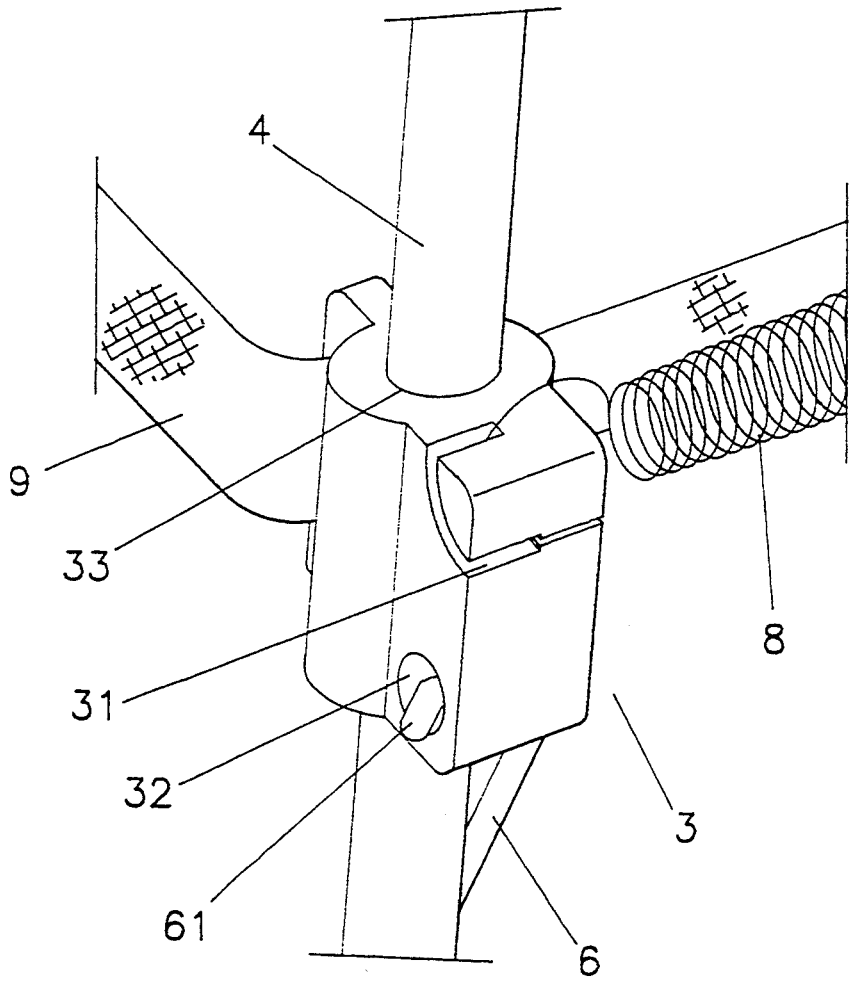
FIG. 5 is an enlarged view of the locating frame of the folding golf bag stand mounting hardware shown in FIG. 2.

Referring to FIG. 5, the locating frame 3 comprises a longitudinal through hole 33, which receives either leg 4, a spring mounting notch 31 at one side, which holds either end of the compression spring 8, a hanging hole 32 below the spring mounting notch 31, which holds either end 61 of the connecting rod 6.

Figure 6:
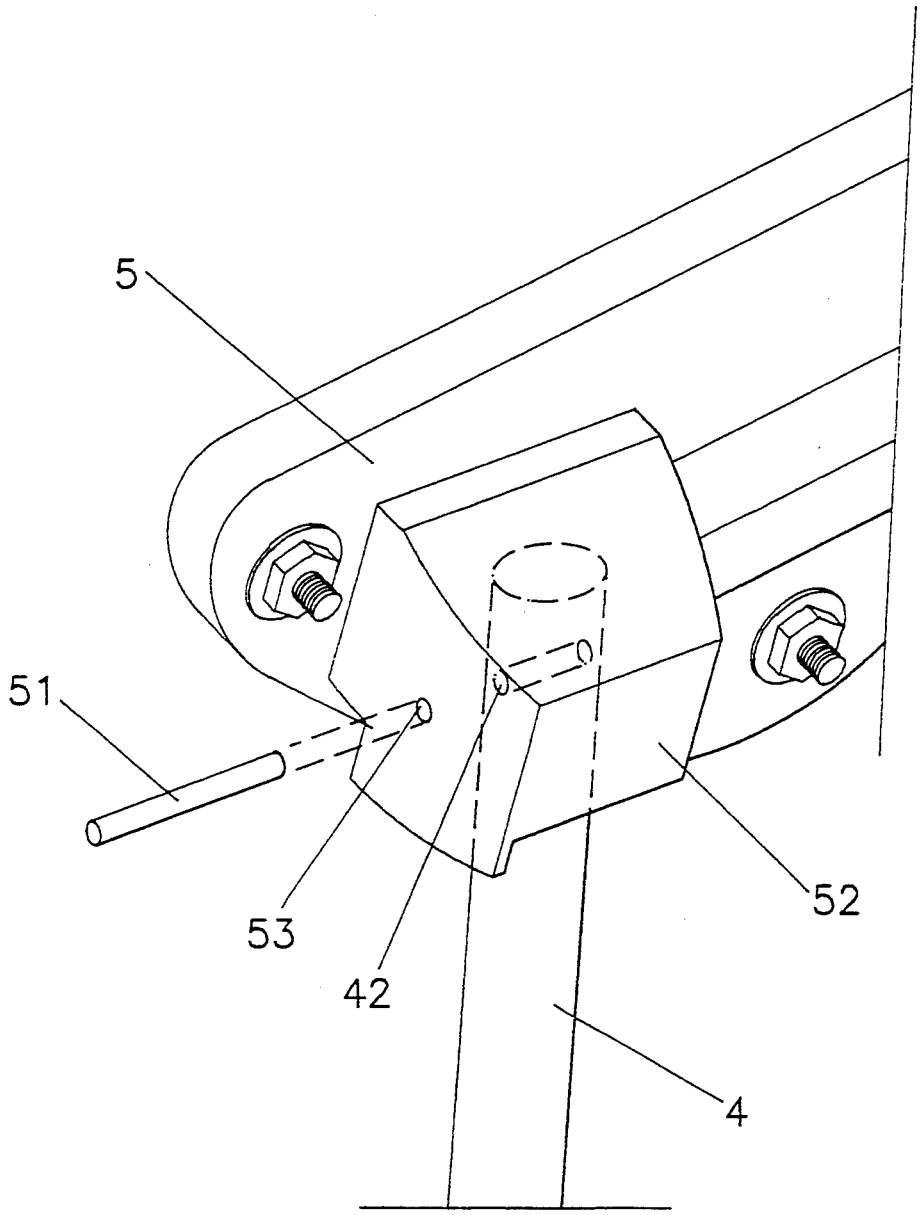
FIG. 6 is a perspective view in an enlarged scale of the top mounting frame of the folding golf bag stand mounting hardware shown in FIG. 2.

Referring to FIG. 6 and FIG. 2 again, the leg has pin hole 42 near the top end thereof pivotably fastened to a respective socket 52 on the top mounting frame 5.

Referring to FIGS. 2 and 6 again, the top mounting frame 5 is fastened to the golf bag 1 near the top cuff thereof, having two sockets 52 to hold either leg 4. The socket 52 has a bottom opening (not shown), which receive either leg 4, a pivot hole 53 across the bottom opening and connected to the pivot hole 53 on the respective leg 4 by a pivot pin 51.

Figure 7:
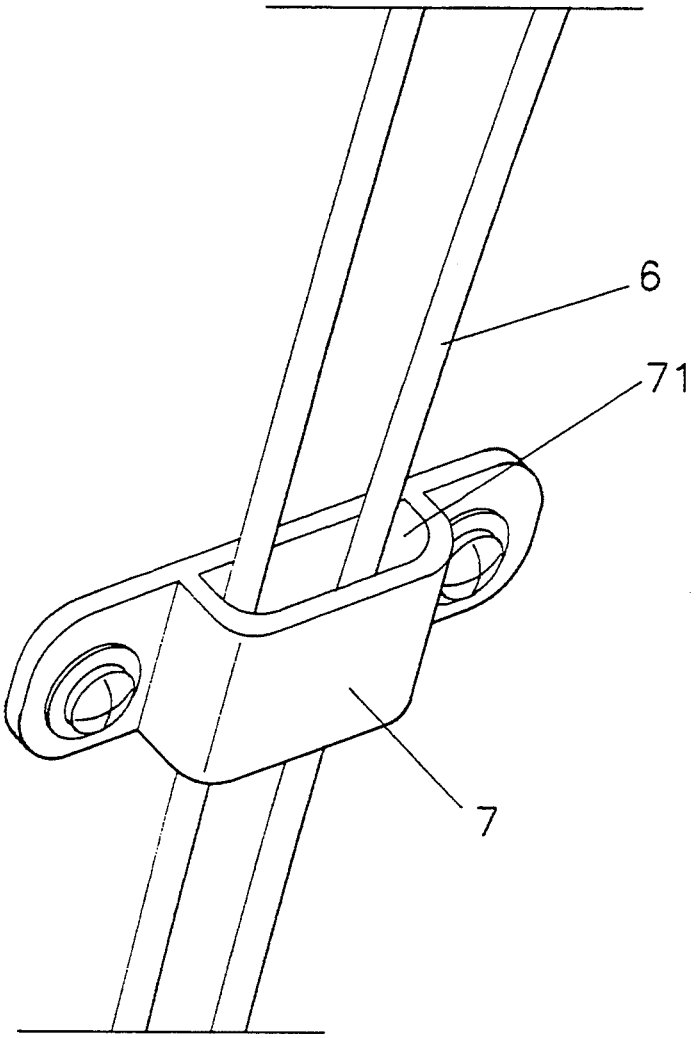
FIG. 7 is an enlarged view of the constraint member of the folding golf bag stand mounting hardware shown in FIG. 2.
Figure 8:
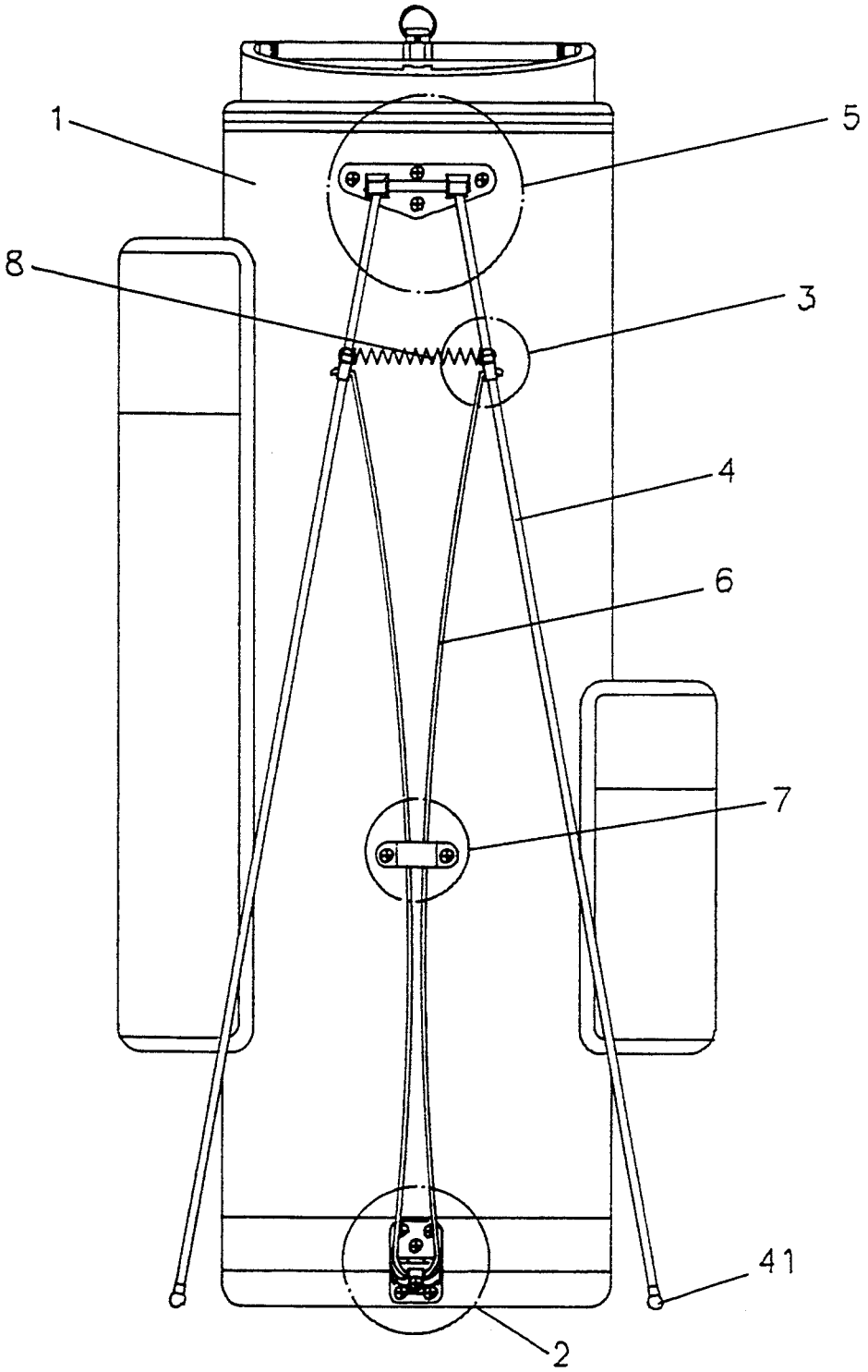
FIG. 8 is a front plain view of the folding golf bag stand mounting hardware shown in FIG. 2.

Referring to FIG. 7, the constraint member 7 is fastened to the golf bag 1 and aligned between the top mounting frame 5 and the bottom mounting frame 2, having a constraint hole 71, which receives the connecting rod 6.

Referring to FIG. 2 again, the connecting rod 6 is inserted through the constraint hole 71 on the constraint member 7, having a middle part 61 hung on the loop 21 of the bottom mounting frame 2 and two opposite ends 61 respectively and pivotably connected to either socket 52 on the top mounting frame 5.

Referring to FIGS. 2 and 5 again, the compression spring 8 has two opposite ends respectively fastened to the spring mounting notch 31 on either locating frame 3.

Referring to FIG. 2 again, the adjustable fastening strap 9 is inserted through a respective loop (not shown) on either locating frame 3, having two opposite ends respectively fastened to the golf bag 1 at an elevation between the top mounting frame 5 and the constraint member 7. By adjusting the adjustable fastening strap 9, the swinging angle of the legs 4 relative to each other is confined.

Referring to FIG. 2 again, when the golf bag 1 is placed on the ground, the legs 4 are forced by the pressure of the golf bag 1 to swing outwards, causing the golf bag 1 supported on the legs 4 and the supporting plate 23 of the bottom mounting frame 2 in a sloping position.

While only one embodiment of the present invention has been shown and described, it will be understood that various modifications and changes could be made without departing from the spirit and scope of the invention.

What is claimed is:

1. Folding golf bag stand mounting hardware comprising:

a golf bag body having a top cuff around a top opening thereof and a blocked up;

a top bottom mounting frame fastened to said golf bag body near the top cuff and having two sockets spaced at the same elevation, each socket having a bottom opening and a horizontal pivot hole across the bottom opening;

two legs respectively pivoted to either socket to support said golf bag body on the ground in a sloping position, each leg having a top end inserted into the bottom opening on either socket and pivoted to the respective pivot hole by a respective pivot pin and a bottom end mounted with a cushion;

a bottom mounting frame mounted on said golf bag body near the bottom thereof, said bottom mounting frame comprising a vertical mounting plate fastened to said golf bag body by screws, a smoothly curved supporting plate having one end pivoted to said vertical mounting plate in the middle, said supporting plate comprising a stop bar at one end, which stops at said vertical mounting plate when said supporting plate is extended outwards from said vertical mounting plate, a loop at an opposite end, and a shoe and a friction block spaced on a bottom wall thereof, which stop on the ground to support the supporting plate in position when said supporting plate is extended out;

a constraint member fastened to said golf bag body and aligned between said top mounting frame and said bottom mounting frame, said constraint member having a constrain hole;

two locating frames respectively mounted on said legs and spaced below said top mounting frame, each locating frame comprising a longitudinal through hole, which receives either leg, a spring mounting notch at one side, a loop at an opposite side, a hanging hole below said spring mounting notch;

a compression spring supported between said legs, having two opposite ends respectively fastened to the spring mounting notch on either locating frame;

an adjustable fastening strap inserted through the loop on either locating frame and having two opposite ends respectively fastened to said golf bag body; and a connecting rod inserted through the constraint hole on said constraint member and having a bend in the middle hung on the loop on said supporting plate of said bottom mounting frame and two opposite ends respective hung on the hanging hole on either locating frame.

2. The folding golf bag stand mounting hardware of claim 1 wherein said friction block and said shoe of said supporting plate of said bottom mounting frame have a respective bottom wall corrugated.

* * * * *